US005803759A

United States Patent [19]

Griffith et al.

[11] Patent Number: 5,803,759

[45] Date of Patent: Sep. 8, 1998

[54] TWO WAY ELECTRICAL CONNECTOR

[76] Inventors: Samuel G. Griffith, 7463 Vintage Ln., West Bloomfield, Mich. 48322; John V. Antilla, 11946 Lewlund, Sterling Heights, Mich. 48313

[21] Appl. No.: 690,429

[22] Filed: Jul. 26, 1996

[51] Int. Cl.[6] ..... H01R 13/52

[52] U.S. Cl. ..... 439/274; 439/271; 439/589; 439/595

[58] Field of Search ..... 439/271, 274, 439/275, 276, 277, 279, 282, 587, 588, 589, 595

[56] References Cited

U.S. PATENT DOCUMENTS

| | | | |
|---|---|---|---|
| 3,937,545 | 2/1976 | Cairns et al. | 439/272 |
| 4,166,664 | 9/1979 | Herrmann, Jr. | 439/275 |
| 4,214,472 | 7/1980 | Maxwell et al. | 439/272 |
| 4,214,802 | 7/1980 | Otani et al. | 439/275 |
| 4,284,312 | 8/1981 | Patchett et al. | 439/272 |
| 4,498,719 | 2/1985 | Juris et al. | 439/272 |
| 4,517,017 | 5/1985 | Fujita | 439/275 |
| 4,621,883 | 11/1986 | Noguchi | 439/275 |
| 4,637,674 | 1/1987 | Kobler | 439/275 |
| 4,698,027 | 10/1987 | Vandame | 439/271 |
| 4,709,123 | 11/1987 | Yamashita et al. | 439/282 |
| 4,711,509 | 12/1987 | Cross et al. | 439/271 |
| 4,735,581 | 4/1988 | Endo et al. | 439/278 |
| 4,768,970 | 9/1988 | Nestor | 439/278 |
| 4,772,231 | 9/1988 | Hayes | 439/272 |
| 4,797,116 | 1/1989 | Isohata et al. | 439/274 |
| 4,810,208 | 3/1989 | Hayes et al. | 439/281 |
| 4,820,181 | 4/1989 | Kuzuno et al. | 439/272 |
| 4,836,802 | 6/1989 | Phillips | 439/281 |
| 4,874,325 | 10/1989 | Bensing et al. | 439/272 |
| 4,895,533 | 1/1990 | Yagi et al. | 439/278 |
| 4,900,271 | 2/1990 | Colleran et al. | 439/275 |
| 4,921,437 | 5/1990 | Cooper et al. | 439/275 |
| 4,936,791 | 6/1990 | Zielinski et al. | 439/271 |
| 4,940,420 | 7/1990 | Munie | 439/271 |
| 4,946,402 | 8/1990 | Fink et al. | 439/274 |
| 4,950,175 | 8/1990 | Plyler et al. | 439/274 |
| 4,973,266 | 11/1990 | Bullard | 439/281 |
| 4,993,803 | 2/1991 | Suverison et al. | 439/283 |
| 4,998,896 | 3/1991 | Lundergan | 439/274 |
| 5,021,923 | 6/1991 | Zinn | 439/272 |
| 5,078,622 | 1/1992 | Hunt, III et al. | 439/282 |
| 5,104,253 | 4/1992 | Zielinski et al. | 439/271 |
| 5,108,303 | 4/1992 | Maeda et al. | 439/271 |
| 5,112,241 | 5/1992 | Chesnut et al. | 439/273 |
| 5,114,359 | 5/1992 | Chishima et al. | 439/271 |
| 5,197,898 | 3/1993 | Nagamine | 439/271 |
| 5,224,872 | 7/1993 | Noda et al. | 439/282 |
| 5,234,352 | 8/1993 | Bungo et al. | 439/282 |
| 5,240,431 | 8/1993 | Yagi et al. | 439/271 |
| 5,263,873 | 11/1993 | Landries | 439/271 |
| 5,304,073 | 4/1994 | Golobay et al. | 439/282 |
| 5,324,208 | 6/1994 | Kodama et al. | 439/271 |
| 5,328,382 | 7/1994 | Pawlicki | 439/273 |
| 5,336,101 | 8/1994 | Kasugai et al. | 439/272 |
| 5,350,311 | 9/1994 | Roy et al. | 439/273 |
| 5,358,420 | 10/1994 | Cairns et al. | 439/271 |
| 5,389,005 | 2/1995 | Kodama | 439/272 |
| 5,431,574 | 7/1995 | Shinchi | 439/271 |
| 5,435,738 | 7/1995 | Isohata | 439/271 |
| 5,435,743 | 7/1995 | Farah | 439/274 |
| 5,484,301 | 1/1996 | Koumatsu et al. | 439/271 |
| 5,498,170 | 3/1996 | Tanaka | 439/271 |

*Primary Examiner*—Gary F. Paumen
*Assistant Examiner*—Brian J. Biggi
*Attorney, Agent, or Firm*—Thomas G. Pasternak

[57] ABSTRACT

A two way electrical connector for an automotive vehicle includes a terminal insulator having at least one passage to receive at least one socket terminal staked wire, a wedge member cooperating with the terminal insulator to retain the at least one socket terminal staked wire in the at least one passage, a ring seal disposed about the terminal insulator and an end cap cooperating with the terminal insulator to retain the ring seal between the terminal insulator and the end cap.

16 Claims, 2 Drawing Sheets

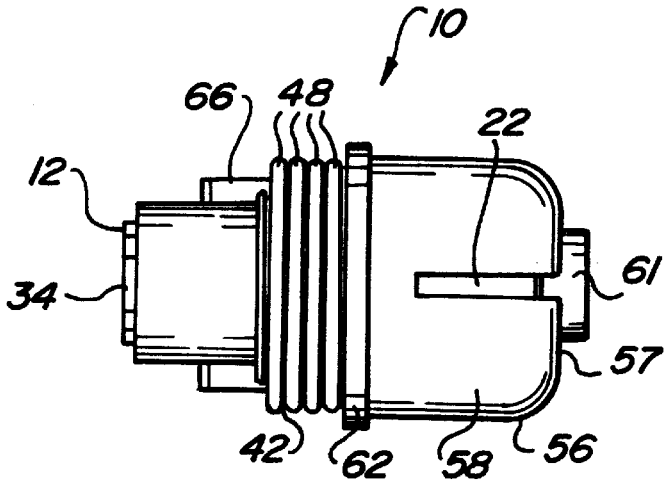
Fig-4
Fig-5
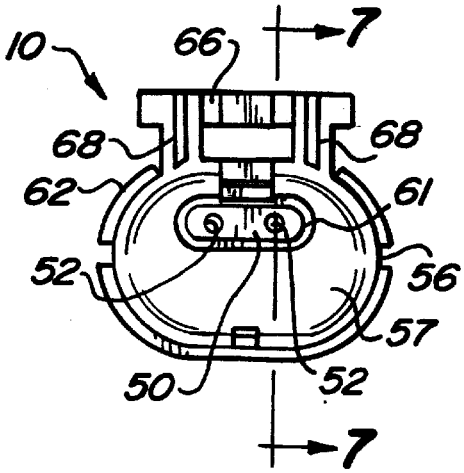
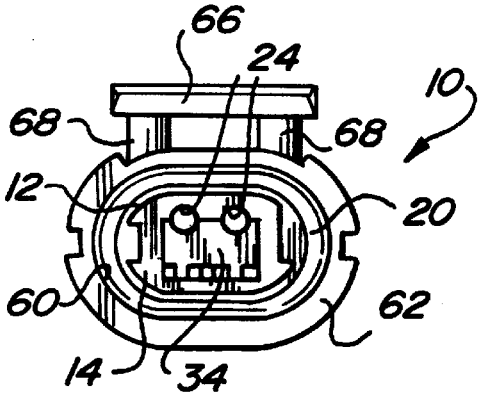
Fig-6
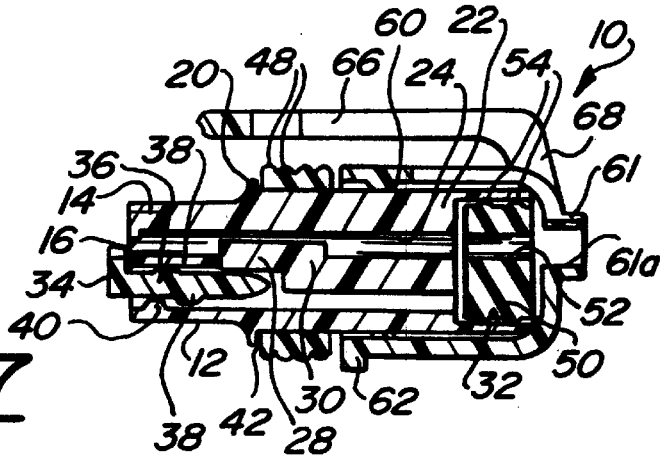
Fig-7

TWO WAY ELECTRICAL CONNECTOR

BACKGROUND OF THE INVENTION

1. Field of the Invention

The present invention relates generally to electrical connectors and, more particularly, to a two way electrical connector for an automotive vehicle.

2. Description of the Related Art

Electrical connectors have been provided to connect and retain wires together on an automotive vehicle. These electrical connectors typically include a terminal insulator having a ring seal and a retainer or end cap assembled to the terminal insulator.

One disadvantage of these electrical connectors is that sealed electrical contact is required to effect an assembly which may be difficult to achieve. Another disadvantage is that the retainer or end cap typically requires a shroud for alignment and proper assembly to a mating device which may be difficult under assembly conditions. Thus, there is a need in the art to provide a two way electrical connector for an automotive vehicle which provides improved seal retention and alignment.

SUMMARY OF THE INVENTION

It is, therefore, one object of the present invention to provide a two way electrical connector for an automotive vehicle.

It is another object of the present invention to provide a female two way electrical connector for an automotive vehicle which makes a sealed electrical contact when mated with a male two way electrical connector or electrical device.

It is yet another object of the present invention to provide a two way electrical connector for an automotive vehicle with improved seal retention.

It is still another object of the present invention to provide a two way electrical connector having alignment between the electrical connector and a mating connector.

To achieve the foregoing objects, the present invention is a two way electrical connector for an automotive vehicle including a terminal insulator having at least one passage to receive at least one socket terminal staked wire. The two way electrical connector also includes a wedge member cooperating with the terminal insulator to retain the at least one socket terminal staked wire in the at least one passage. The two-way electrical connector further includes a ring seal disposed about the terminal insulator and an end cap cooperating with the terminal insulator to capture and retain the ring seal between the terminal insulator and the end cap.

One feature of the present invention is that a two way electrical connector is provided for an automotive vehicle. Another feature of the present invention is that the two way electrical connector has a terminal insulator with a forward flange or stay to capture or retain a ring seal between the forward flange and an end cap assembled to the terminal insulator. Yet another feature of the present invention is that the end cap is made with or without a connector alignment shroud which positions and aligns the electrical connector with a mating device before electrical terminals engage protecting male pin terminals from damage.

Other objects, features and advantages of the present invention will be readily appreciated as the same becomes better understood after reading the subsequent description taken in conjunction with the accompanying drawings.

BRIEF DESCRIPTION OF THE DRAWINGS

FIG. 4 is a bottom view of the two way electrical connector of FIG. 1;

FIG. 5 is a front elevational view of the two way electrical connector of FIG. 1;

FIG. 6 is a rear end view of the two way electrical connector of FIG. 1; and FIG. 7 is a sectional view taken along line 7—7 of FIG. 6.

DESCRIPTION OF THE PREFERRED EMBODIMENT(S)

Figure 1:
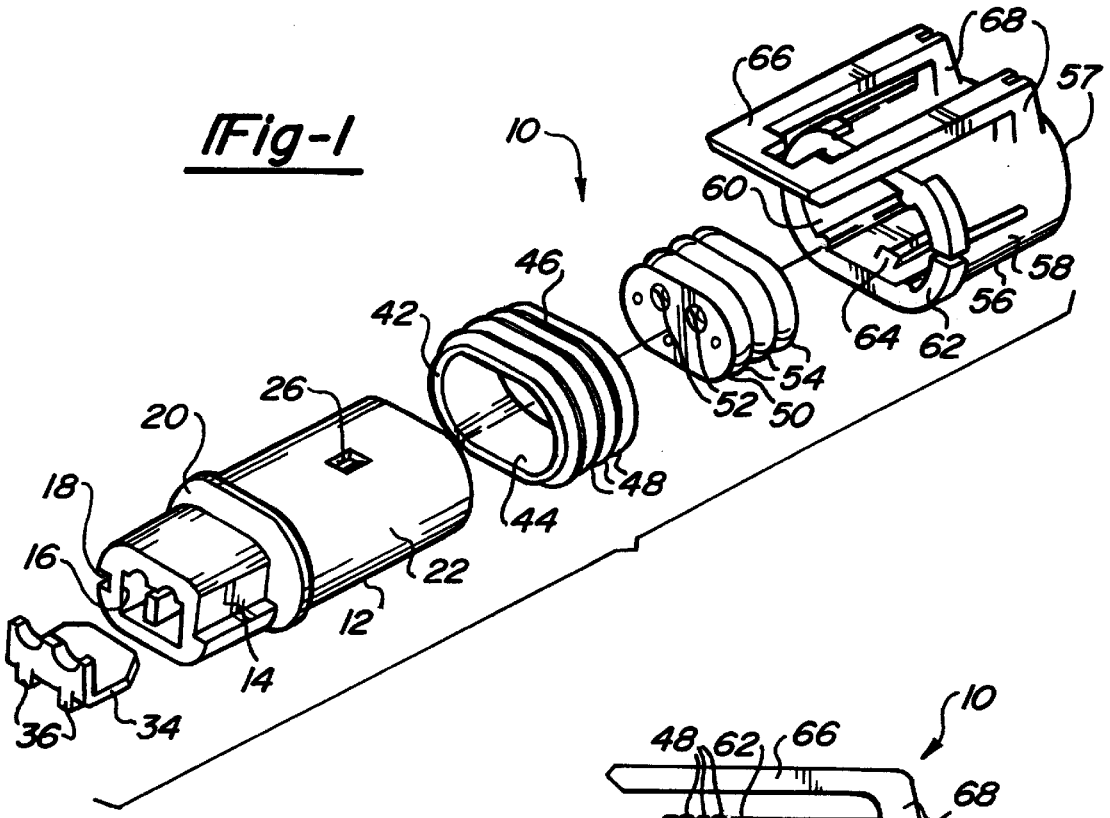
FIG. 1 is an exploded perspective view of a two way electrical connector, according to the present invention.
Figure 2:
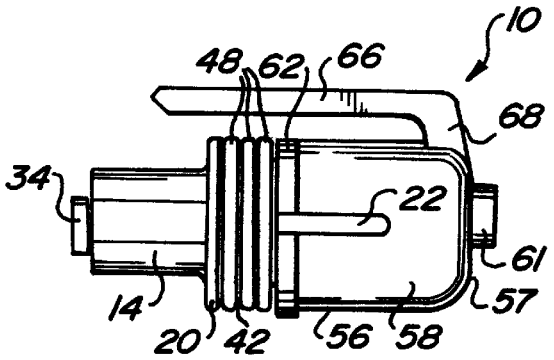
FIG. 2 is a right side view of the two way electrical connector of FIG. 1.
Figure 3:
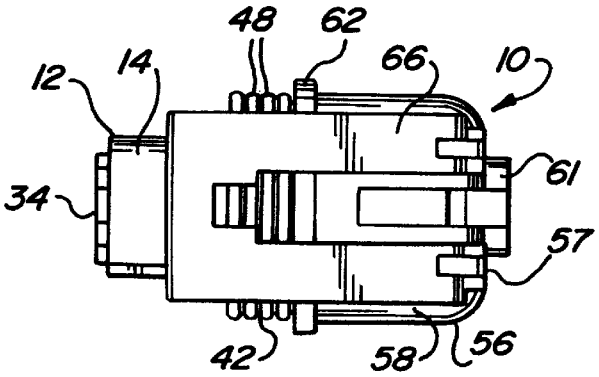
FIG. 3 is a plan view of the two way electrical connector of FIG. 1.

Referring to FIGS. 1 through 7, a two way electrical connector 10, according to the present invention, is shown for an automotive vehicle (not shown). The two way electrical connector 10 is used for receiving and retaining socket terminal staked wires (not shown) and for mating with a male two way electrical connector (not shown) and/or various electrical devices (not shown) throughout the automotive vehicle. It should be appreciated that socket terminal staked wires are conventional and known in the art.

The two way electrical connector 10 includes a terminal insulator 12 for receiving the socket terminal staked wires. The terminal insulator 12 is preferably a one-piece molded plastic member. The terminal insulator 12 includes a forward engaging shroud 14 having a cavity 16 contoured to receive and align a wedge to be described. Preferably, the shroud 14 and cavity 16 extend longitudinally and are generally oval in shape. The forward engaging shroud 14 has a polarizing portion 18 which extends vertically and longitudinally to form a channel to receive and align with a suitably designed projection on a mating electrical connector and/or electrical device of the automotive vehicle which can be located as desired to provide four different polarizations. It should be appreciated that the polarizing portion 18 prevents assembly of the terminal insulator 12 to an incorrect mating electrical connector and/or electrical device.

The terminal insulator 12 includes a forward stay or flange 20 disposed about and extending vertically from the forward engaging shroud 14 for a function to be described. The terminal insulator 12 further includes a terminal receiving portion 22 extending longitudinally from the forward stay 20 to receive terminal wires (not shown). The terminal receiving portion 22 is generally oval in shape. The terminal receiving portion 22 includes at least one, preferably a plurality of passages 24 extending longitudinally therethrough and communicating with the cavity 16. The terminal receiving portion 22 includes at least one, preferable a pair of opposed recesses 26 on an outer surface and extending inwardly for a function to be described. The terminal receiving portion 22 also includes a terminal retention finger 28 disposed in each passage 24 and having a projection (not shown) which engages a flange in the socket terminal staked wire (not shown). The terminal retention finger 28 extends longitudinally and is cantilevered by a connecting portion 30 to the terminal receiving portion 22. The terminal receiving portion 22 also includes a seal cavity 32 at one end thereof for a function to be described. The seal cavity 32 is generally oval in shape and communicates with the passages 24. It should be appreciated that the terminal receiving portion 22 is integral and formed as one-piece with the shroud 14. It should also be appreciated that the connecting portion 30 allows the terminal retention finger 28 to be flexed or deflected to engage or disengage the hole in the socket terminal staked wire.

The two way electrical connector 10 also includes a wedge member 34 which cooperates with the terminal retention fingers 28. The wedge member 34 has a generally "L" shaped profile. The wedge member 34 includes at least one locking wedge pad 36 extending vertically and longitudinally from a lower surface thereof. The wedge member 34 also includes a preload locking projection 38 extending vertically and longitudinally from an upper surface thereof and which cooperates with a projection 40 extending inwardly into the cavity 16 from the forward engaging shroud 14. The wedge member 34 is preferably a one-piece molded plastic member.

In operation, each socket terminal staked wire is fully inserted in each of the passages 24. The wedge member 34 is deliberately slid underneath the terminal retention finger 28 and a divider 39 in the cavity 16. The preload locking projection 38 engages the projection 40 and the locking wedge pad 36 deflects the divider 39 and the preload locking projection 38 passes over the projection 40. When in the fully assembled position as illustrated in FIG. 7, the wedge member 34 prevents the retention finger 28 from flexing, locking the socket terminal staked wire (not shown) into place.

The two way electrical connector 10 includes a ring seal 42 disposed about the terminal insulator 12. The ring seal 42 is tubular and generally oval in shape. The ring seal 42 has an inner surface 44 and an outer surface 46. The ring seal 42 extends longitudinally and has at least one, preferably a plurality of ribs 48 extending radially outwardly and circumferentially to engage a mating electrical connector. Preferably, the ring seal 42 is made of an elastomeric material.

The two way electrical connector 10 also includes an end seal 50 disposed in the seal cavity 32 of the terminal receiving portion 22. The end seal 50 extends longitudinally and is generally oval in shape. The end seal 50 includes at least one, preferably a plurality of apertures 52 extending longitudinally therethrough and aligned with the passages 24 of the terminal receiving portion 22. The end seal 50 also includes at least one, preferably a plurality of ribs 54 extending radially outwardly and circumferentially to engage a surface of the seal cavity 32. Preferably, the end seal 50 is made of an elastomeric material.

The two way electrical connector 10 also includes a retainer or an end cap 56. The end cap 56 is generally oval in shape and includes a base wall 57 and a side wall 58 forming a cavity 60. The base wall 57 has a flange 61 extending longitudinally with an aperture 61*a* extending therethrough. The side wall 58 has a flange 62 extending radially outwardly and circumferentially to engage the ring seal 42. The end cap 56 includes at least one, preferably a plurality of locking projections 64 extending upwardly from the side wall 58 and into the cavity 60 which cooperate with the recesses 26 of the terminal receiving portion 22. The end cap 56 has a shroud 66 extending longitudinally for alignment and engagement with a mating electrical connector. The shroud 66 is cantilevered to the side wall 58 by connecting portions 68. The end cap 56 is formed as a one piece plastic member.

In operation, the end seal 50 is disposed in the seal cavity 32 and the wedge member 34 is disposed in the cavity 16 of the terminal insulator 12. The ring seal 42 is disposed about the terminal receiving portion 22 such that the inner surface 44 engages the outer surface of the terminal receiving portion 22. The ring seal 42 is moved longitudinally toward the forward flange 20. The end cap 54 is moved longitudinally toward the ring seal 42 such that the terminal receiving portion 22 is disposed in the cavity 60 and the locking projections 64 engage the recesses 26 to capture the end seal 50 in the seal cavity 32 and the ring seal 42 between the forward flange 20 and the end cap 54.

According, the two way electrical connector 10 improves ring seal retention and makes sealed electrical contact with a mated male two way electrical connector and/or electrical device of the automotive vehicle. The two way electrical connector 10 has a terminal insulator 12 to receive and retain a plurality of socket terminal staked wires. When the socket terminal staked wires are properly installed within the terminal insulator 12, the wedge member 34 can be fully assembled to lock the socket terminal staked wires in position within the terminal insulator 12. Additionally, the end cap 54 may be made with or without a connector alignment and ring seal protecting shroud to capture the end seal 54 in the seal cavity 32 and the ring seal 42 between the forward flange 20 and flange 62 of the end cap 54.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A two way electrical connector for an automotive vehicle comprising:

a terminal insulator having at least one passage to receive at least one socket terminal staked wire, said terminal insulator having a first flange extending outwardly from an outer periphery thereof;

a wedge member cooperating with said terminal insulator to retain the at least one socket terminal staked wire in said at least one passage;

a ring seal disposed about an outer periphery of said terminal insulator; and an end cap having a first cavity to receive a portion of said terminal insulator and a second flange extending outwardly from an outer periphery thereof to engage said ring seal and to retain said ring seal between said terminal insulator and said end cap.

2. A two way electrical connector as set forth in claim 1 wherein said terminal insulator has a forward engaging shroud including a second cavity to receive said wedge member.

3. A two way electrical connector as set forth in claim 2 wherein said forward engaging shroud includes a polarizing portion which aligns and prevents misassembly to a mating connector.

4. A two way electrical connector as set forth in claim 2 including at least one locking projection extending from said end cap and into said first cavity for cooperating with at least one recess on said terminal insulator.

5. A two way electrical connector as set forth in claim 2 wherein said terminal insulator includes a terminal receiving portion extending from said forward engaging shroud and forming said at least one passage.

6. A two way electrical connector as set forth in claim 5 wherein said terminal receiving portion includes a terminal retention finger disposed in said at least one passage to engage the at least one socket terminal staked wire.

7. A two way electrical connector for an automotive vehicle comprising:

a terminal insulator having at least one passage to receive at least one socket terminal staked wire;

a wedge member cooperating with said terminal insulator to retain the at least one socket terminal staked wire in said at least one passage;

a ring seal disposed about said terminal insulator;

an end cap cooperating with said terminal insulator to retain said ring seal between said terminal insulator and said end cap;

said terminal insulator having a forward engaging shroud including a cavity to receive said wedge member and a terminal receiving portion extending from said forward engaging shroud and forming said at least one passage, said terminal receiving portion including a terminal retention finger disposed in said at least one passage to engage the at least one socket terminal staked wire; and wherein said forward engaging shroud has a divider extending into said cavity and a projection extending into said cavity.

8. A two way electrical connector as set forth in claim 7 wherein said wedge member has a preload locking projection and is disposed between said divider and said projection such that said preload locking projection is disposed longitudinally past said projection to engage said terminal retention finger.

9. A two way electrical connector as set forth in claim 7 including a seal cavity disposed at one end of said terminal receiving portion.

10. A two way electrical connector as set forth in claim 9 including an end seal disposed in said seal cavity.

11. A two way electrical connector as set forth in claim 10 wherein said end seal has at least one aperture extending longitudinally therethrough and aligned with said at least one passage.

12. A two way electrical connector as set forth in claim 7 wherein said wedge member is generally "L" shaped.

13. A female two way electrical connector for an automotive vehicle comprising:

a terminal insulator having a forward engaging shroud including a shroud cavity and a terminal receiving portion extending from said forward engaging shroud and forming a seal cavity and at least one passage extending from said seal cavity to receive at least one socket terminal staked wire, said forward engaging shroud having a divider extending into said shroud cavity and a projection extending into said shroud cavity;

an end seal disposed in said seal cavity and having at least one aperture extending therethrough and aligned with said at least one passage to receive the at least one socket terminal staked wire;

a wedge member received in said shroud cavity and cooperating with said terminal insulator to retain the at least one socket terminal staked wire in said at least one passage;

a ring seal disposed about said terminal insulator; and an end cap cooperating with said terminal insulator to capture said end seal in said seal cavity and to capture said ring seal between said terminal insulator and said end cap.

14. A female two way electrical connector as set forth in claim 13 wherein said terminal insulator includes a flange extending from said forward engaging shroud.

15. A female two way electrical connector as set forth in claim 13 wherein said end cap has an end cavity to receive a portion of said terminal insulator and a flange to engage said ring seal.

16. A female two way electrical connector as set forth in claim 13 wherein said terminal receiving portion includes a terminal retention finger disposed in said at least one passage to engage the socket terminal.

* * * * *

UNITED STATES PATENT AND TRADEMARK OFFICE

CERTIFICATE OF CORRECTION

PATENT NO. : 5,803,759

DATED : September 8, 1998

INVENTOR(S) : Samuel G. Griffith, et al.

It is certified that error appears in the above-indentified patent and that said Letters Patent is hereby corrected as shown below:

On the title page, item[73], please insert the following:

Assignee: Chrysler Corporation, Auburn Hills, Mich.

Signed and Sealed this

Twenty-eighth Day of September, 1999

*Attest:*

Q. TODD DICKINSON

*Attesting Officer*

*Acting Commissioner of Patents and Trademarks*